US009140254B2

(12) United States Patent
Hwang et al.

(10) Patent No.: US 9,140,254 B2
(45) Date of Patent: Sep. 22, 2015

(54) SYSTEM FOR CONTROLLING AN ELECTRIC OIL PUMP

(75) Inventors: Jin Young Hwang, Suwon-si (KR); Se Hwan Jo, Goyang-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 732 days.

(21) Appl. No.: 13/529,806

(22) Filed: Jun. 21, 2012

(65) Prior Publication Data

US 2013/0136623 A1 May 30, 2013

(30) Foreign Application Priority Data

Nov. 29, 2011 (KR) ..... 10-2011-0126328

(51) Int. Cl.

| | |
|---|---|
| ***F04B 49/00*** | (2006.01) |
| ***F04B 49/03*** | (2006.01) |
| ***F04B 17/03*** | (2006.01) |
| ***F04B 49/22*** | (2006.01) |

(52) U.S. Cl.

CPC ..... *F04B 49/03* (2013.01); *F04B 17/03* (2013.01); *F04B 49/22* (2013.01); *Y10T 137/86059* (2015.04); *Y10T 477/69393* (2015.01); *Y10T 477/69395* (2015.01); *Y10T 477/693958* (2015.01)

(58) Field of Classification Search

CPC . F16H 61/00; F16H 61/0025; F16H 61/0206; F16H 61/684; Y10T 137/86059; Y10T 477/69393; Y10T 477/69395; Y10T 477/693958; F04B 17/03; F04B 49/03; F04B 49/22

USPC ..... 417/307, 308, 302–304, 297, 507; 477/156–159; 60/413; 137/47, 50, 495, 137/498; 91/413; 251/30.01

See application file for complete search history.

(56) References Cited

U.S. PATENT DOCUMENTS

| | | | | |
|---|---|---|---|---|
| 4,147,093 | A * | 4/1979 | Dunn | 91/510 |
| 5,028,851 | A * | 7/1991 | Wilder | 318/2 |
| 2010/0313980 | A1 * | 12/2010 | Shimizu et al. | 137/625.64 |

FOREIGN PATENT DOCUMENTS

| | | | |
|---|---|---|---|
| JP | 3723459 | B2 | 9/2005 |
| JP | 2008-249042 | A | 10/2008 |
| KR | 10-2011-0062911 | A | 6/2011 |

* cited by examiner

*Primary Examiner* — Peter J Bertheaud
*Assistant Examiner* — Dominick L Plakkoottam
(74) *Attorney, Agent, or Firm* — Morgan, Lewis & Bockius LLP

(57) ABSTRACT

A system for accurately and reliably controlling an electric oil pump includes a control portion adapted to control rotation speed of the motor of the electric oil pump, a regulator valve including a valve body provided with a plurality of ports, a valve spool inserted in the valve body and an elastic member adapted to apply elastic force to the valve spool, and a switch mounted on one side of the valve body including first and second contact points, wherein the control portion increases the rotation speed of the motor when the switch is on and maintains the rotation speed of the motor when the switch is off.

10 Claims, 3 Drawing Sheets

SYSTEM FOR CONTROLLING AN ELECTRIC OIL PUMP

CROSS-REFERENCE TO RELATED APPLICATION

The present application claims priority of Korean Patent Application Number 10-2011-0126328 filed Nov. 29, 2011, the entire contents of which application is incorporated herein for all purposes by this reference.

BACKGROUND OF INVENTION

1. Field of Invention

The present invention relates to a system for controlling an electric oil pump, and more particularly, to the system for controlling a motor of the electric oil pump at an optimal speed for a target hydraulic pressure.

2. Description of Related Art

An automatic transmission of vehicle includes a torque converter and a power train connected to the torque converter and having a multi-stage transmission mechanism. The automatic transmission further includes an electric oil pump for supplying operation pressure to the transmission and a transmission control unit (TCU) for controlling the transmission.

When controlling the electric oil pump, the TCU should operate the electric oil pump with an optimal motor speed so as to generate line pressure required in the transmission and clutches. To reach the target hydraulic pressure, the conventional art generally uses a method where a data map of the required motor speed is set in advance. Whether the target hydraulic pressure is reached is determined by using a hydraulic pressure sensor, and the motor speed is controlled through feedback control.

The conventional art, however, has problems such that the cost increases because a hydraulic pressure sensor having a high degree of accuracy and durability should be used. In addition, the conventional art has further problems, for example, an error of the sensor or a malfunction of the feedback control may occur due to hydraulic pulsation and vibration.

Also, driving loss may increase because the above-mentioned data map is determined based on low quality products considering operation deviation of the electric oil pump or the sensor according to the conventional method, Further, it is impossible to control the electric oil pump reflecting or compensating the durability deterioration thereof due to use of the pump according to the conventional art.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present application are directed to provide a system for controlling an electric oil pump having advantages of reducing driving losses, reducing cost, and controlling the motor or with an optimal rotation speed (RPM) by taking into account deterioration of the electric oil pump.

Various aspects of the present invention provide for a system for controlling an electric oil pump driven by a motor includes a control portion adapted to control rotation speed of the motor of the electric oil pump, a regulator valve including a valve body provided with a plurality of ports, a valve spool inserted in the valve body, and an elastic member adapted to apply elastic force toward one side of the valve spool, and a switch mounted on one side of the valve body, comprising a first contact point that is movable relative to the valve body and a second contact point fixed on the one side of the valve body, and transferring information to the control portion on whether the first and second contact points are in contact or not, wherein the regulator valve converts hydraulic pressure received from the electric oil pump into an operating pressure and supplies the operating pressure, and the valve spool receives at least a portion of the operating pressure as a first control pressure and is movable in the valve body by a resultant force of the first control pressure and the elastic force, and the first and second contact points contact each other such that the control portion maintains the rotation speed of the motor when a force generated by the first control pressure is larger than or equal to the elastic force by a first predetermined value.

The first and second contact points may be separated from each other such that the control portion increases the rotation speed of the motor when the force generated by the first control pressure is smaller than the elastic force by a second predetermined value. The second predetermined value may be the same as the first predetermined value. Alternatively, the second predetermined value may be different than the first predetermined value.

The system may include a variable force solenoid valve that provides a second control pressure against the first control pressure to the other side of the regulator valve.

The valve body may include a first port for receiving the hydraulic pressure from the electric oil pump, a second port for converting the hydraulic pressure of the first port into the operating pressure so as to supply the operating pressure, a third port for receiving the portion of the operating pressure as the first control pressure, a fourth port for receiving the second control pressure from the variable force solenoid valve, and a fifth port for exhausting the operating pressure of the second port.

A penetration hole may be formed at the one side of the valve body, and wherein the valve spool has a pressurizing portion protruded toward the switch such that the pressurizing portion penetrates through the penetration hole and applies a force to the first electric contact point when the valve spool moves toward the switch.

The control portion may be a transmission control unit (TCU).

The elastic member may be a return spring that is mounted at a space where the second control pressure of the variable force solenoid valve is acted.

The system may include a pressurizing spring mounted at the one side of the first contact point so as to supply an elastic force for contacting the first and second contact points.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
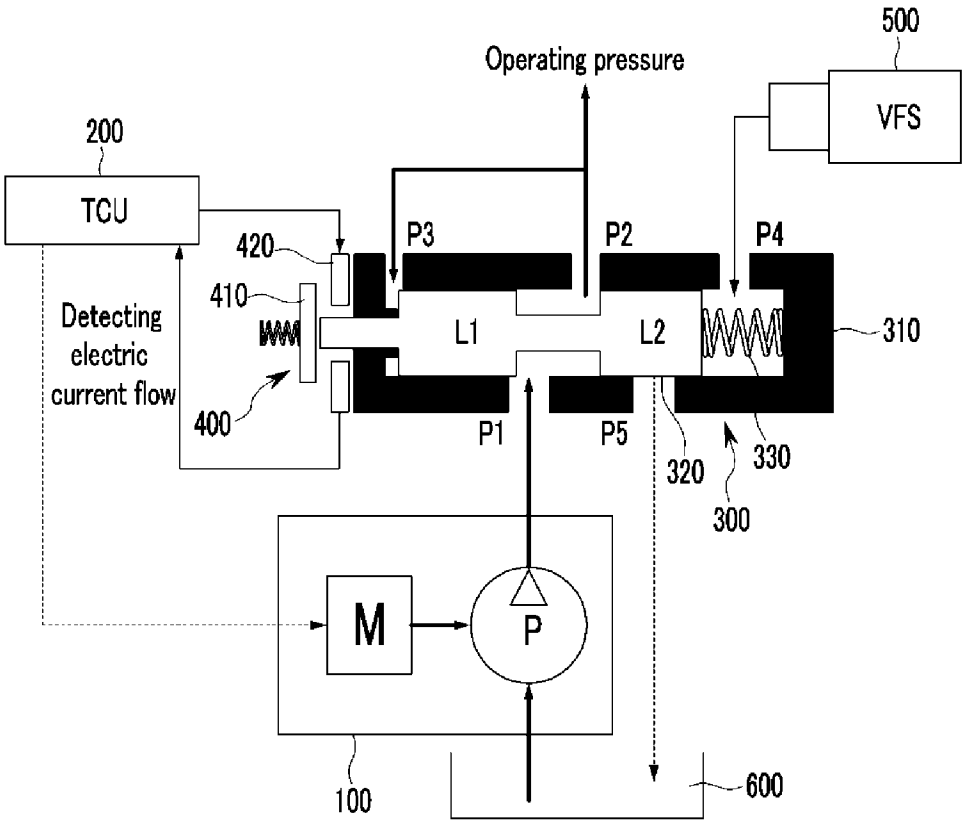
FIG. 1 is a schematic diagram of an exemplary system for controlling an electric oil pump according to the present application.

FIG. 1 is a schematic diagram of a system for controlling an electric oil pump 100 according to various embodiments of the present application. As shown in FIG. 1, a system for controlling an electric oil pump 100 according to various embodiments of the present application includes a control portion 200 adapted to control rotation speed of the motor of the electric oil pump 100, a regulator valve 300 including a valve body 310 provided with a plurality of ports P1-P5, a valve spool 320 inserted in the valve body 310, and an elastic member 330 adapted to apply elastic force toward one side of the valve spool 320, and a switch 400 adapted to be electrically conductive due to a contact of a first contact point 410 and a second contact point 420.

The control portion 200 controls the electric oil pump 100. As shown in FIG. 1, the control portion 200 detects whether the switch 400 is electrically conducting and controls the rotation speed of the motor M of the electric oil pump 100 based on whether the switch 400 is electrically conducting.

The control portion 200 controls an oil amount of the pump P by controlling the rotation speed of the motor M. Thereby, the hydraulic pressure supplied to the regulator valve 300 is controlled to be a target hydraulic pressure.

The control portion 200 may be a transmission control unit (TCU), an electric oil pump 100 unit (OPU) which directly controls the electric oil pump 100, a motor control unit (MCU) etc. The control portion 200 may be a transmission control unit (TCU) because the electric oil pump 100 according to various embodiments of the present application is used for an automatic transmission of the vehicle.

The regulator valve 300 plays a role in controlling the hydraulic pressure generated from the electric oil pump 100 as a line pressure corresponding to each shift-speed and supplying the line pressure at each shift-speed.

Figure 2:
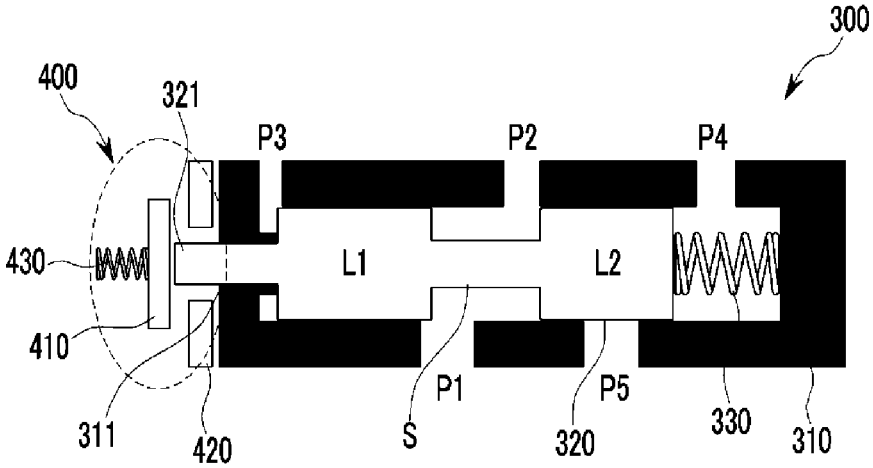
FIG. 2 is a schematic diagram of an exemplary regulator valve when the switch is in an off state according to the present application.

The regulator valve 300, as shown in FIG. 2, may include the valve body 310 provided with the plurality of ports P1-P5, the valve spool 320 inserted in the valve body 310, and the elastic member 330 adapted to apply elastic force toward the one side of the valve spool 320.

The regulator valve 300 converts the hydraulic pressure received from the electric oil pump 100 into an operating pressure and supplies the operating pressure, and the valve spool 320 receives at least a portion of the operating pressure as a first control pressure and is movable in the valve body 310 by a resultant force of the first control pressure and the elastic force of the elastic member 330.

The valve body 310 is provided with the plurality of ports P1-P5, as shown in FIG. 2. The valve body 310 may include a first port P1 for receiving the hydraulic pressure from the electric oil pump 100, a second port P2 for converting the hydraulic pressure of the first port P1 into the operating pressure so as to supplying the operating pressure, a third port P3 for receiving the portion of the operating pressure of the second port P2 as the first control pressure, a fourth port P4 for receiving the second control pressure from a variable force solenoid valve (VFS) 500, and a fifth port P5 for exhausting the operating pressure of the second port P2 to an oil tank 600.

Figure 3:
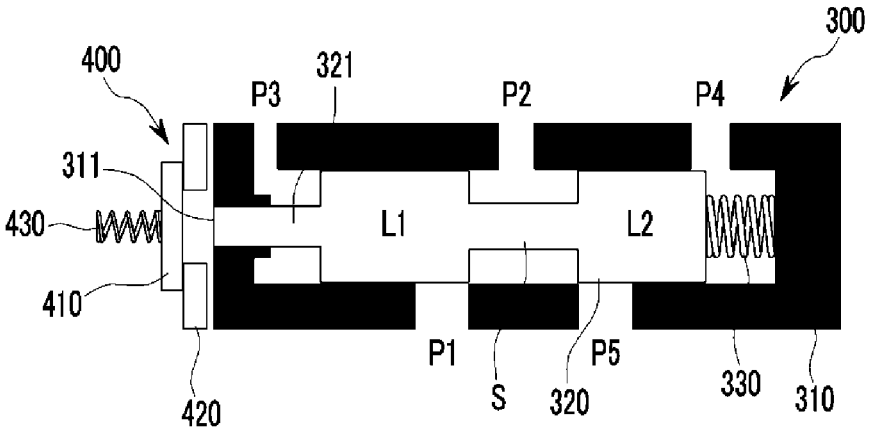
FIG. 3 is a schematic diagram of an exemplary regulator valve when the switch is in an on state according to the present application.

The valve spool 320, as shown in FIG. 2 and FIG. 3, may include a spool shaft S, and first and second lands L1 and L2 may be formed integrally and/or monolithically at an outer surface of the spool shaft S, and a pressurizing portion 321 protruded forwardly from the first land L1. The pressurizing portion 321 can pass through a penetration hole 311 that is formed at the one side portion of the valve body 310.

Herein, the first land L1 is disposed so as to control the amount of the oil flowing between the first port P1 and the second port P2, and the second land L2 is disposed apart from the first land L1 by a predetermined distance so as to control the amount of the oil flowing between the fourth port P4 and the fifth port P5.

The elastic member 330 is mounted in the valve body 310 and provides elastic force to the valve spool 320. The elastic member 330, as shown in FIG. 2, may be a return spring mounted between a rear surface of the valve spool 320 and an interior circumference of the valve body 310. Therefore, the return spring provides restoring force to the valve spool 320.

The switch 400, as shown in FIG. 1, is mounted at the one side of the valve body 310 and is electrically conductive by contacting of the first contact point 410 and the second contact point 420.

The switch 400 includes the first contact point 410 that is movable relative to the valve body 310 and the second contact point 420 fixed on the one side of the valve body 310, and transfers information to the control portion 200 on whether the first and second contact points 410 and 420 are in contact or not.

The switch 400 is turned on when the first and second contact points 410 and 420 contact each other, and the switch 400 is turned off when the first and second contact points 410 and 420 are separated from each other.

As shown in FIG. 2, the first and second contact points 410 and 420 may be elastically contacted by a pressurizing spring 430 mounted at the one side of the first contact point 410.

In various embodiments, the valve spool 320 moves in the valve body 310 and applies pressure to the first contact point 410 of the switch 400 in an opposite direction of the elastic force of the pressurizing spring 430. Therefore, the first and second contact points 410 and 420 are separated.

As shown in FIG. 2 and FIG. 3, the valve body 310 is provided with the penetration hole 311 that is formed at the side of the valve body 310 where the switch 400 is mounted, and the valve spool 320 may be integrally and/or monolithically formed with the pressurizing portion 321 protruded toward the switch 400 such that the pressurizing portion 321 penetrates through the penetration hole 311.

The pressurizing portion 321 penetrates through the penetration hole 311 and applies a force to the first electric contact point in a direction opposite to a direction of elastic force of the pressurizing spring 430 when the valve spool 320 moves toward the switch 400.

If the force applied by the pressurizing portion 321 of the valve spool 320 is larger than that of the pressurizing spring 430, the first contact point 410 is separated from the second contact point 420, and therefore the switch 400 is turned off.

The pressurizing portion 321 of the valve spool 320 moves toward the switch 400 and pressurizes the first contact point 410 when the force of the first control pressure is smaller than the elastic force of the elastic member 330 by a first predetermined value, and as a result the first and second contact points 410 and 420 are separated from each other. The switch 400 is turned off when the first contact point 410 is separated from the second contact point 420, and the control portion 200 detects an off state of the switch 400 and increases the rotation speed of the motor M.

On the contrary, The pressurizing portion 321 of the valve spool 320 moves in the opposite direction of the switch 400 when the force of the first control pressure is larger than or equal to the elastic force of the elastic member 330 by a second predetermined value, and as a result the first and second contact points 410 and 420 contact each other. In this case, switch 400 is turned on and the control portion 200 detects the on state of the switch 400 and maintains the rotation speed of the motor M. In some embodiments, the second predetermined value is the same as the first predetermined value. In some embodiments, the second predetermined value is different than the first predetermined value.

In addition, the system may include a variable force solenoid valve (VFS) 500 at the other side of the regulator valve 300. The variable force solenoid valve 500 is adapted to supply a second control pressure against the first control pressure to the regulator valve 300.

The regulator valve 300 converts the hydraulic pressure received from the electric oil pump 100 through the first port P1 into an operating pressure and supplies the operating pressure to the second port P2.

The valve spool 320 is adapted to receive the portion of the operating pressure as the first control pressure through the third port P3, and to receive the second control pressure of the variable force solenoid valve 500 from the fourth port P4.

As shown in FIG. 2, in a case that the system includes the variable force solenoid valve 500, the valve spool 320 is movable in the valve body 310 by a resultant force of the force of the first control pressure, the force of the second control pressure of the variable force solenoid valve 500, and the elastic force of the elastic member 330.

Hereinafter, the operation of the system for controlling an electric oil pump 100 according to various embodiments of the present application will be described.

The system for controlling an electric oil pump 100, as shown in FIG. 2, represents an off state of the switch 400 because the first and second contact points 410 and 420 are separated from each other since the pressurizing portion 321 presses the first contact point 410 through the penetration hole 311.

The portion of the operating pressure of the electric pump 100 is provided as the first control pressure through the third port P3, and the force of the first control pressure presses the valve spool 320 in the opposite direction of the switch 400. Meanwhile, the force of the second control pressure of the variable force solenoid valve (VFS) 500 provided through the fourth port P4 presses the valve spool 320 in the direction of the switch 400, and the elastic force of the return spring is also applied to the valve spool 320. The valve spool 320 moves forward to the first contact point 410 and separates the first and the second contact points 410 and 420 by pressing the first contact point 410 when the force of the first control pressure is smaller than the elastic force by the predetermined value of the force of the second control pressure.

The control portion 200 increases the rotation speed of the motor when it detects the off state of the switch 400. The rotation speed of the motor M increases, and as a result that the amount of the oil flowing provided from the first port P1 by the pump P is increased, and therefore the hydraulic pressure is also increased.

The valve spool 320 moves backward to the first contact point 410 and then the first and the second contact points 410 and 420 contact each other because of the pressurizing spring 430 when the force of the first control pressure is larger than the elastic force by the predetermined value of the force of the second control pressure. In this case, as shown in FIG. 3, the switch 400 is turned on.

If the switch 400 is turned on, it means the hydraulic pressure of the electric oil pump 100 has reached the target hydraulic pressure. Therefore the control portion 200 maintains the rotation speed of the motor M when it detects the on-state of the switch 400.

As described above, the present application has an effect of reducing cost because there is no need to have extra equipment like an expensive sensor, and has an effect of improving accuracy and reliability because the present application can find an optimal rotation speed of the motor regardless of a deviation of an electric oil pump or sensor.

In addition, when the performance of the electric oil pump is degraded, the present application can compensate the degradation of the electric oil pump immediately because the present application can control the rotation speed of the motor reflecting the change of hydraulic pressure according to the degradation of the electric oil pump.

For convenience in explanation and accurate definition in the appended claims, the terms "larger" or "smaller", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A system for controlling an electric oil pump driven by a motor, comprising:

a control portion adapted to control a rotation speed of the motor of the electric oil pump;

a regulator valve comprising a valve body provided with a plurality of ports, a valve spool inserted in the valve body, and an elastic member adapted to apply an elastic force toward one side of the valve spool; and a switch mounted on one side of the valve body, the switch comprising a first contact point that is movable relative to the valve body and a second contact point that is fixed on the one side of the valve body, and the switch transferring information to the control portion on whether the first and second contact points are in contact or not, wherein the regulator valve converts a hydraulic pressure received from the electric oil pump into an operating pressure and supplies the operating pressure, and the valve spool receives at least a portion of the operating pressure as a first control pressure and is movable in the valve body by a resultant force of the first control pressure and the elastic force, and the first and second contact points contact each other such that the control portion maintains the rotation speed of the motor when a force generated by the first control pressure is larger than or equal to the elastic force by a first predetermined value.

2. The system of claim 1, wherein the first and second contact points are separated from each other such that the control portion increases the rotation speed of the motor when the force generated by the first control pressure is smaller than the elastic force by a second predetermined value.

3. The system of claim 1, further comprising a variable force solenoid valve that provides a second control pressure against the first control pressure to the other side of the regulator valve.

4. The system of claim 3, wherein the valve body comprises:

a first port for receiving the hydraulic pressure from the electric oil pump;

a second port for converting the hydraulic pressure of the first port into the operating pressure to supply the operating pressure;

a third port for receiving the portion of the operating pressure as the first control pressure;

a fourth port for receiving the second control pressure from the variable force solenoid valve; and a fifth port for exhausting the operating pressure of the second port.

5. The system of claim 1, wherein a penetration hole is formed at the one side of the valve body, and wherein the valve spool has a pressurizing portion protruded toward the switch such that the pressurizing portion penetrates through the penetration hole and applies a force to the first contact point when the valve spool moves toward the switch.

6. The system of claim 1, wherein the control portion is a transmission control unit (TCU).

7. The system of claim 3, wherein the elastic member is a return spring that is mounted at a space where the second control pressure of the variable force solenoid valve acts.

8. The system of claim 1, further comprising a pressurizing spring mounted at the one side of the first contact point to supply an elastic force for contacting the first and second contact points.

9. The system of claim 2, wherein the second predetermined value is the same as the first predetermined value.

10. The system of claim 2, wherein the second predetermined value is different than the first predetermined value.

* * * * *